United States Patent [19]

Waris

[11] Patent Number: 4,554,052

[45] Date of Patent: Nov. 19, 1985

[54] METHOD AND APPARATUS FOR WEB FORMING

[75] Inventor: Tapio Waris, Kyminlinna, Finland

[73] Assignee: A. Ahlstrom Osakeyhtio, Noormarkku, Finland

[21] Appl. No.: 626,549

[22] Filed: Jul. 2, 1984

Related U.S. Application Data

[63] Continuation of Ser. No. 415,227, Sep. 7, 1982, abandoned.

[30] Foreign Application Priority Data

Sep. 29, 1981 [FI] Finland ..... 813027

[51] Int. Cl.[4] ..... D21F 3/04; D21F 9/02; D21F 11/02

[52] U.S. Cl. ..... 162/203; 162/300; 162/301; 162/306

[58] Field of Search ..... 162/300, 301, 303, 306, 162/305, 208, 210, 217, 203, 205

[56] References Cited

U.S. PATENT DOCUMENTS

| | | | |
|---|---|---|---|
| 3,150,037 | 9/1964 | Lee | 162/308 |
| 3,846,233 | 11/1974 | Kankaanpaa | 162/312 |
| 4,100,018 | 7/1978 | Wahren et al. | 162/301 |
| 4,172,759 | 10/1979 | Kankaanpaa | 162/306 |
| 4,176,005 | 11/1979 | Bubik et al. | 162/301 |
| 4,257,844 | 3/1981 | Schmitt et al. | 162/305 |
| 4,417,950 | 11/1983 | Bubik et al. | 162/300 |

*Primary Examiner*—Steve Alvo

*Attorney, Agent, or Firm*—Buchnam and Archer

[57] ABSTRACT

A method and apparatus for forming a web wherein a fiber suspension from a head box is fed on a section of a forming wire formed by a first, substantially horizontal dewatering zone, and where the web being formed is thereafter led to a second dewatering zone where an upper wire is caused to cover said web, and both wires together with the web between them are led over a turning member. In the twin wire dewatering zone the wires bend upwards. After the turning member the web runs further linearly between the wires obliquely upwards. The web and the lower wire run around a pick-up suction roll and the upper wire leaves the web. The dewatering in the dewatering zones occurs only in one direction, i.e. through the forming wire.

5 Claims, 2 Drawing Figures

METHOD AND APPARATUS FOR WEB FORMING

Figure 1:
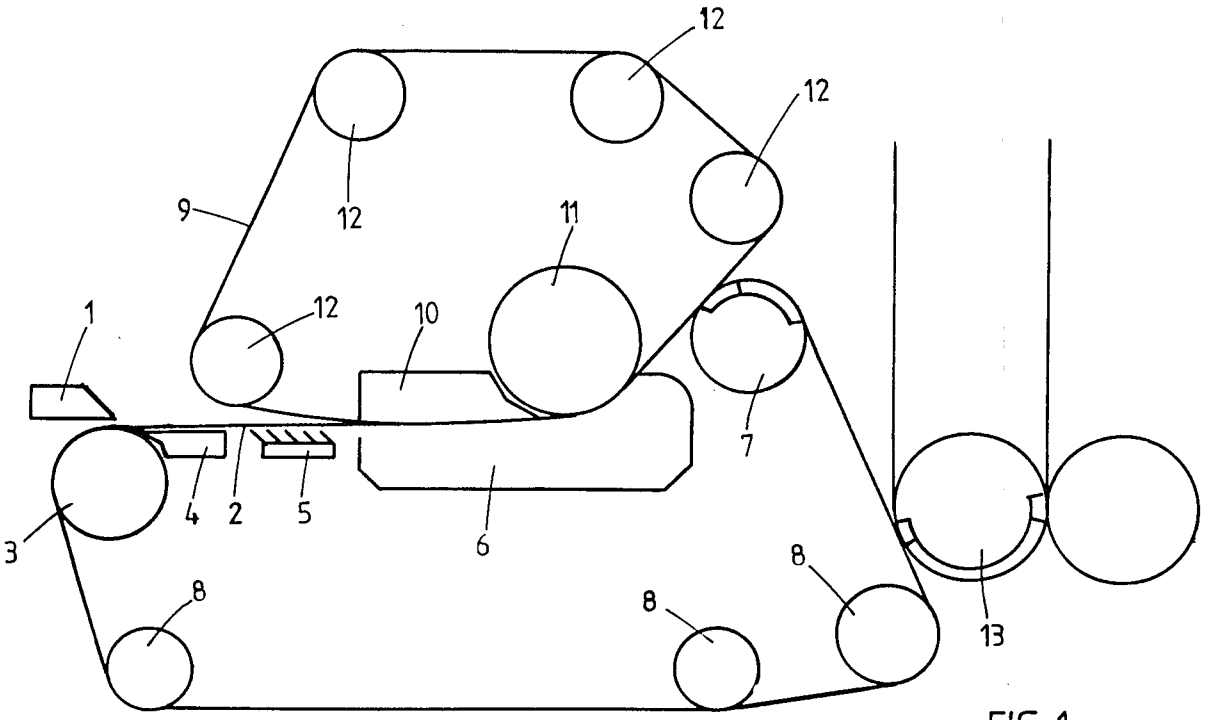

This is a continuation of application Ser. No. 415,227 filed Sept. 7, 1982, now abandoned.

The present invention is related to a web forming method wherein the fiber suspension from a head box is fed on a section of a forming wire formed by a first, substantially horizontal dewatering zone, and in which method the web being formed is led to a second dewatering zone where an upper wire is caused to cover said web, and both wires together with the web between them are led over a turning member, and to an apparatus for carrying out the method.

The present papermaking processes often yield an asymmetric product in which the upper and lower surface of the paper differ from each other as regards their properties, e.g. the upper surface of fourdrinier paper is smoother than the lower surface, where the flushing effect of the dewatering member depletes the web of the fine fiber matter of the surface layer and thus makes the fiber composition of the web uneven. In twin wire formers a more symmetrical structure is usually reached, as the dewatering is performed through both wires—this may, however, result in two uneven surfaces, particularly in those cases where pulsating dewatering means, such as foils, are used—though a symmetric structure.

In the method according to the invention, fourdrinier wire and former principles have been applied to so that the water is removed to one direction, downwards, whereby the upper surface becomes smooth, as is usual in fourdrinier applications. At the same time, in the dewatering performed downwards, as little flushing as possible is used. The depleting of fine fiber matter from the lower surface cannot be prevented in the beginning of the fourdrinier section, but the situation is improved in the twin wire section when the non-pulsating dewatering member or members bring, together with the water being removed, fine fiber matter to the lower surface of the web.

A non-pulsating dewatering member consists of a curved, fixed and/or moving surface which is impervious to water. The surface is preferably smooth, but when it is a moving surface, it may also be grooved or otherwise cavitied, e.g. blindbored. With regard to non-pulsating dewatering, it is essential that the radius of curvature of the dewatering member is big. The radius of curvature of the fixed surface can be made changing so that in the beginning the radius is big, e.g. 5 to 20 m and in the return side 1 to 5 m.

When the non-pulsating dewatering member consists of a fixed shoe with a curved surface and a roll, the diameter of the roll is dimensioned with regard to the curvature of the shoe so that the radius of curvature of the roll is smaller or as big as the radius of the shoe in the return side.

Figure 2:
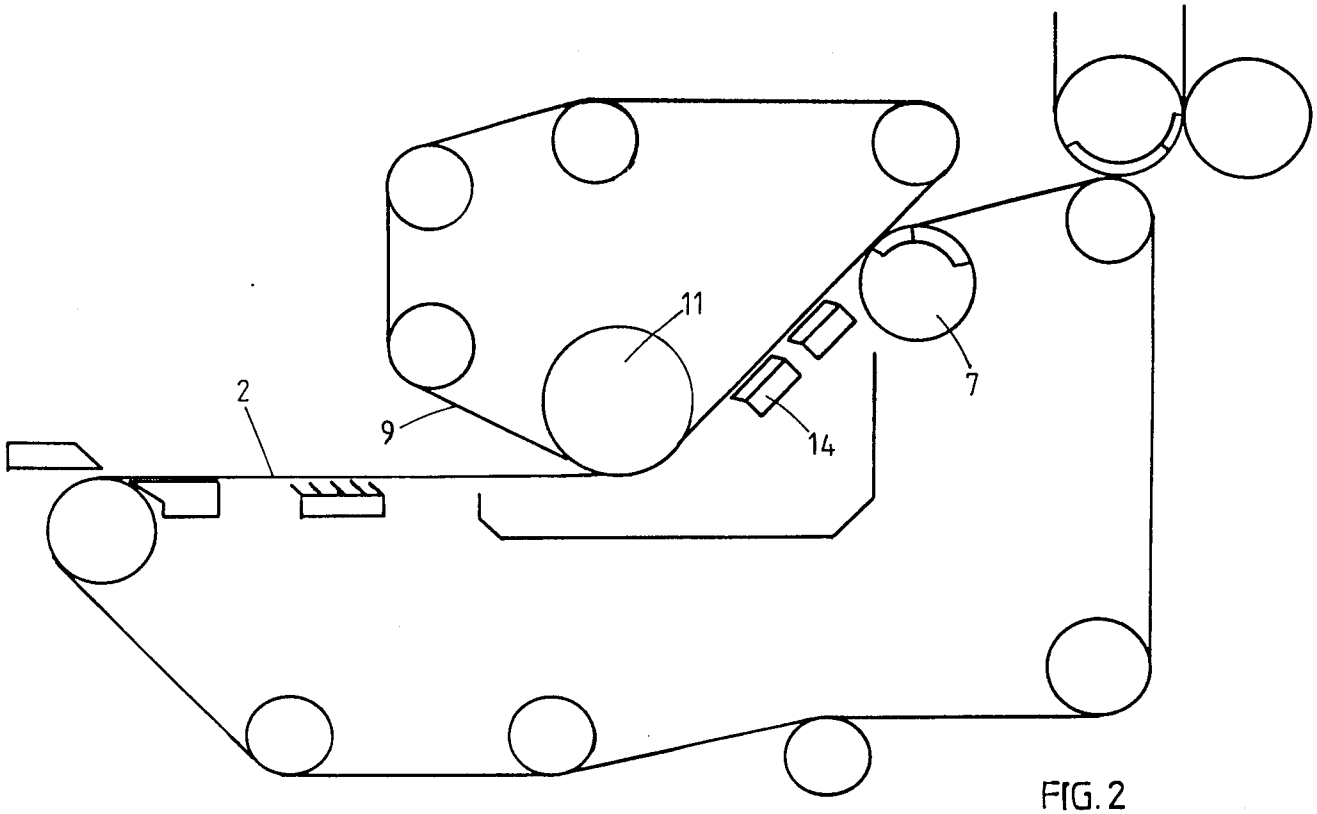

The invention is further described in the following with reference to the attached drawings. In the drawings:

FIG. 1 shows a schematic side view of a web forming apparatus according to the invention; and FIG. 2 shows another embodiment according to the invention.

The web forming apparatus shown in FIG. 1 comprises a head box 1, a lower wire loop 2 and inside it a breast roll 3, dewatering members, such as a forming board 4 and foils 5, a water box 6, a suction roll 7 and wire guide rolls 8.

The web forming apparatus comprises also an upper wire loop 9 within which there is disposed a shoe 10 with a curved surface and a roll 11 as well as wire guide rolls 12.

The dewatering means 4 and 5 can be of any known structure and suction effect can also be combined to them. The shoe 10 and the roll 11 have smooth surfaces and are impervious to water.

The following is a description of the function of the web forming apparatus:

The head box 1 feeds the stock to the lower wire 2 which operates as a web forming wire and which after the breast roll 3 first runs substantially horizontally. The dewatering from the web being formed is done in two stages. The first stage is performed in a single wire section of the web forming apparatus, which operates substantially in the same way as a conventional fourdrinier wire section. In the second stage the upper wire supported by the shoe 10 having a curved surface meets the web and the web's direction of motion between the upper and lower wire curves upwards. In both stages the dewatering is performed to the same direction, namely through the lower wire. After the roll 11 the web continues its linear motion between the wires in a direction deflecting from the original (the direction of the fourdrinier section) less than 90°. The web and the lower wire run around the pick-up suction roll 7 and the upper wire continues its motion almost linearly to a guide roll 12 by-passing the suction roll, in other words it makes at the most a minor change of direction near the suction roll. The web is detached from the lower wire by means of a pick-up roll 13 or the like and conveyed further to the press section of the machine.

In the web forming device shown in FIG. 2, the upper wire 9 meets the web supported by the roll 11. Dewatering members 14 are disposed inside the lower wire 2 and between the roll 11 and the suction roll 7. After the suction roll the lower wire and the web move obliquely upwards. In many aspects and by its function the apparatus is like that shown in FIG. 1.

The specific embodiments shown are not meant to limit the invention, which can vary within the scope of the claims.

We claim:

1. A web forming method which consists of feeding a fiber suspension from a head box on a section of a lower forming wire comprising a first, substantially horizontal dewatering zone, covering the web with an upper wire, leading the lower wire and the upper wire with the web therebetween to a second dewatering zone, which is a twin dewatering zone upwardly over a deflecting member having a large radius of curvature, said deflecting member being impervious to water, removing the water from the web in the first and second dewatering zone through only said lower wire, deflecting the web in a substantially straight path upwardly in a direction which deviates from the horizontal original direction of travel of the web, by an angle less than 90° up to a suction roll, said deflecting member being located in the upper wire, then detaching the upper wire from the web, causing said upper wire to continue to travel beyond the suction roll upwardly in essentially the same direction as it was upstream of said suction roll, and removing the web from the lower wire.

2. A web forming method according to claim 1, wherein 50 to 90% of the water flowing from the head box is removed in the first dewatering zone.

3. An apparatus for forming a web from a fiber suspension comprising a lower wire loop, a head box for feeding the fiber suspension onto said lower wire loop, at least one dewatering member having a curved impervious surface with a large radius of curvature inside the loop, said wire loop having a first horizontal section, an upper wire disposed to cover the web located over the lower wire, guide rolls being located inside the upper wire, means for moving said upper and lower wires with the web therebetween to a deflecting member, said deflecting member being impervious to water and having a large radius of curvature, and being located in the upper wire, wherein the direction of travel of the web and the wires is deflected upwards by an angle smaller than 90° to travel upwardly in a substantially straight path, a suction roll arranged within the lower wire, means for detaching the upper wire from the web downstream of the suction roll, said guide rolls leading said upper wire upwardly essentially in the same direction as it was upstream of the suction roll, the radius of curvature of said deflecting member being equal to or greater than the radius of curvature of said guide rolls, and means for detaching the web from the lower wire.

4. A web forming apparatus according to claim 3 wherein the curved surface impervious to water is formed by a rotating roll.

5. A web forming apparatus according to claim 3 wherein inside the upper wire loop there is a rotating roll.

* * * * *